US005165255A

United States Patent [19]

Alvarez et al.

[11] Patent Number: 5,165,255

[45] Date of Patent: Nov. 24, 1992

[54] INTERMEDIATE STAGING ICE BIN FOR ICE AND BEVERAGE DISPENSING MACHINES

[75] Inventors: Robert J. Alvarez; Christopher P. Yoerg, both of Denver, Colo.

[73] Assignee: Mile High Equipment Company, Denver, Colo.

[21] Appl. No.: 737,192

[22] Filed: Jul. 29, 1991

[51] Int. Cl.[5] ..... F25C 5/18

[52] U.S. Cl. ..... 62/344; 222/63; 222/129.1; 222/146.6; 366/153; 366/157

[58] Field of Search ..... 62/344; 222/63, 64, 222/129.1, 131, 146.6; 241/DIG. 17; 366/151, 153, 157

[56] References Cited

U.S. PATENT DOCUMENTS 3,151,668 10/1964 Zimmermann ..... 222/146.6 X
3,192,734 7/1965 Swanson ..... 222/64 X
3,552,663 1/1971 Royals ..... 241/DIG. 17
3,827,256 8/1974 Wiesner ..... 62/344 X
4,055,099 10/1977 Mitsubayashi ..... 241/DIG. 17
4,276,750 7/1981 Kawasumi ..... 222/146.6 X
4,745,773 5/1988 Ando ..... 241/DIG. 17

*Primary Examiner*—William E. Tapolcai
*Attorney, Agent, or Firm*—Hubbard, Thurman, Tucker & Harris

[57] ABSTRACT

To insure a continuous supply of ice pieces to a drink dispensing machine having an upwardly open ice piece dispensing compartment, a storage bin is provided in vertical alignment with the ice piece compartment and an ice making machine is mounted on top of the storage bin. A discharge auger is mounted in a discharge opening in the bottom of the ice piece storage bin and is energized by switch means responsive to the level of ice pieces in the ice dispensing compartment.

23 Claims, 8 Drawing Sheets

INTERMEDIATE STAGING ICE BIN FOR ICE AND BEVERAGE DISPENSING MACHINES

BACKGROUND OF THE INVENTION

1. Field of the Invention:

This invention relates generally to ice making and dispensing and more particularly relates to a system for accumulating ice produced by an ice maker at a relatively slow rate over a relatively long period of time and then dispensing the ice on demand to a drink dispensing machine or the like at a faster rate over a shorter period of time, and doing so substantially independently of either the ice making machine or the drink dispenser.

2. Summary of the Prior Art:

Drink dispensing machines are commonly used in restaurants, particularly in the fast food type of restaurants where a large number of drinks must be served during a relatively short rush hour. Such machines are usually dispense the ice from a self-contained storage bin either automatically, or manually, by pushing the container against a lever. These built-in storage bins are of limited volume and are sometimes supplied directly from an ice making machine disposed above the drink dispenser, or manually from a remotely located ice machine.

During rush hour, the demand for ice frequently exceeds the capacity of the built-in storage compartment and the required output will not permit the ice making machine to keep up with the demand. In such a case, it is necessary to manually add ice to the dispensing bin of the drink dispensing machine, which is a substantial inconvenience, not only for the personnel of the restaurant, but also for the customer who might return to the counter for a refill in self service establishments.

To increase the capacity of the ice machines to a level which would permit the machine to produce ice at a rate substantially equal to the peak dispensing rate would require excessive capacity with the resulting higher manufacturing cost. Furthermore, the size of such machine would probably prevent its installation in an overhead position relative to the drink dispensing apparatus and, as is well known, the mounting of the machine at a horizontal location relative to the drink dispensing machine uses up counter space or floor space which is at a premium in a modern fast food restaurant.

SUMMARY OF THE INVENTION

This invention provides a self-contained ice storage system which may be interposed between an ice making machine and the drink dispenser without modifying either, yet can accumulate sufficiently large quantities of ice during non-peak periods and automatically transfer the accumulated ice to the drink dispensing machine during rush time. The storage system has sufficient capacity to provide ice pieces to a drink dispensing machine at an adequately high rate during peak demands so that an ice making machine of smaller capacity has time to replenish the supply of the ice between periods of peak demand.

In a preferred embodiment, the storage unit includes a support which supports the storage bin above a drink dispenser and also supports an ice making machine above the bin to minimize the use of floor space. In an alternative embodiment, both the ice making machine and storage bin may be located behind an interior wall against which the drink dispenser is placed, either at a high level to permit use of the space under the storage bin, or on the floor, in which case an elevating conveyer is provided to move the ice pieces from the storage bin through the wall to the drink dispenser.

An ice storage and discharge apparatus embodying this invention is particularly suited for use with self contained beverage dispensing units. Such units are normally mounted on rollers or slide bars to permit them to be readily moved outwardly for purposes of cleaning or repair. For this reason, the ice storage apparatus embodying this invention is mounted on a separate frame at an elevated position, permitting the self contained beverage dispensing cabinet to be rolled or slid into place beneath the ice storage bin. Such cabinet is provided with an open top ice dispensing compartment and the cabinet is accurately positioned relative to the frame supporting the ice piece storage bin so that ice pieces discharged from the storage bin enter the open top of the ice dispensing compartment.

To insure the accurate alignment of the beverage dispensing compartment, one or more interlock electrical switches are provided on the frame supporting the ice storage bin. These interlock switches are wired into the control circuit for the auger motor, preventing the operation of the auger motor until accurate placement of the self contained beverage dispensing unit in a predetermined position relative to the ice storage bin has been accomplished.

Moreover, when the self contained beverage dispensing unit is pulled out from beneath the ice storage bin, the bottom of the auger chamber is open so that water from melting ice will drip onto the floor. To prevent this occurrence, a drip pan or funnel, connected to a drain line, is mounted on a horizontally swingable arm which is pivotally secured to one of the vertical frame members of the ice storage bin frame and is spring biased to a position underlying the discharge opening for the ice storage bin. When the self contained beverage dispensing cabinet is moved back into the aforementioned predetermined position, the drip pan or funnel is engaged and moved horizontally to a position at the rear of the cabinet where it will not in any manner interfere with the delivery of ice pieces from the ice storage bin.

In accordance with an important aspect of the invention, accumulation of ice from the ice making machine and the dispensing of ice into the drink dispensing machine is accomplished without any electrical interaction with either. The ice storage bin is disposed beneath the ice making machine so that when the storage bin is full, the backup of ice pieces causes the curtain switch, or other sensing means, of the ice making machine to discontinue ice making until the level is reduced. The storage bin includes a resistance sensor which detects an ice full condition in the receiving bin of the drink dispenser. Other types of sensors may be substituted, such as, for example, capacitance, ultrasonic, infrared and photoelectric. A timer allows intermittent dispensing, for example, two minutes out of every twenty, during which time ice may be passed from the storage bin to the drink dispenser. In addition, ice in the storage bin is agitated for a brief interval periodically, for example, two seconds out of every twenty minutes, to prevent the ice pieces from freezing into a solid mass and disrupting operation of the system.

The discharge opening in the bottom of the storage bin is cylindrical and defines a vertical axis extending upwardly through the storage bin. A drive shaft is mounted coaxial with the storage bin and cylindrical discharge opening and is driven by a gear box and motor. An ice discharge control auger is mounted on the bottom of the drive shaft and cooperates with the discharge opening to control discharge of the ice. The auger comprises a single helical vane which terminates at its lower end in an upturned transverse tab portion to prevent discharge of ice pieces unless they are forcibly moved over the tab portion by the rotation of the auger. The ice pieces then drop downwardly into the internal ice bin of the drink dispensing machine. When the helical vane is not rotated, the ice pieces stack up behind the tab in the normal angle of repose of the ice piece, which do not flow downwardly by gravity across the upstanding barrier tab.

Additionally, a plurality of axially spaced, generally radially projecting stirring rods are secured to the intermediate portion of the drive shaft. These stirring rods create sufficient agitation in the body of ice pieces to prevent the ice pieces from forming a solid mass or, if any such solid mass has been formed, will effect the breakup of the solid mass, thus assuring a flow of ice pieces downwardly along the sloped sides of the ice storage bin toward the helical discharge vane.

It is therefore readily apparent that an ice piece storage bin embodying this invention may be employed with self contained beverage dispensing units without in any manner complicating the operation or accessibility of such units.

Other advantages of the invention will be readily apparent to those skilled in the art from the following detailed description, taken in conjunction with the annexed sheets of drawings, on which are shown two preferred embodiments of the invention.

DESCRIPTION OF PREFERRED EMBODIMENTS

Referring first to FIGS. 1–6, a conventional automatic drink dispensing machine 10 is shown having a plurality of conventional liquid dispensing nozzles 10*a* arranged in a horizontally spaced array and a manual ice dispensing nozzle 11 with ice dispensing lever 11*a*, disposed in the center of the array. An automatic ice dispensing nozzle 11*b* is also provided. Suitable compartments 12 are provided below a dispensing shelf 10*b* to accommodate a supply of dispensing cups C. Cups C are also stacked above the automatic ice dispensing section 11*c* for its use. Electronic controls for the machine are contained in a control compartment 15. The machine 10 is preferably self contained in a cabinet and is movable as a unit relative to the floor or a counter surface.

Figure 1:
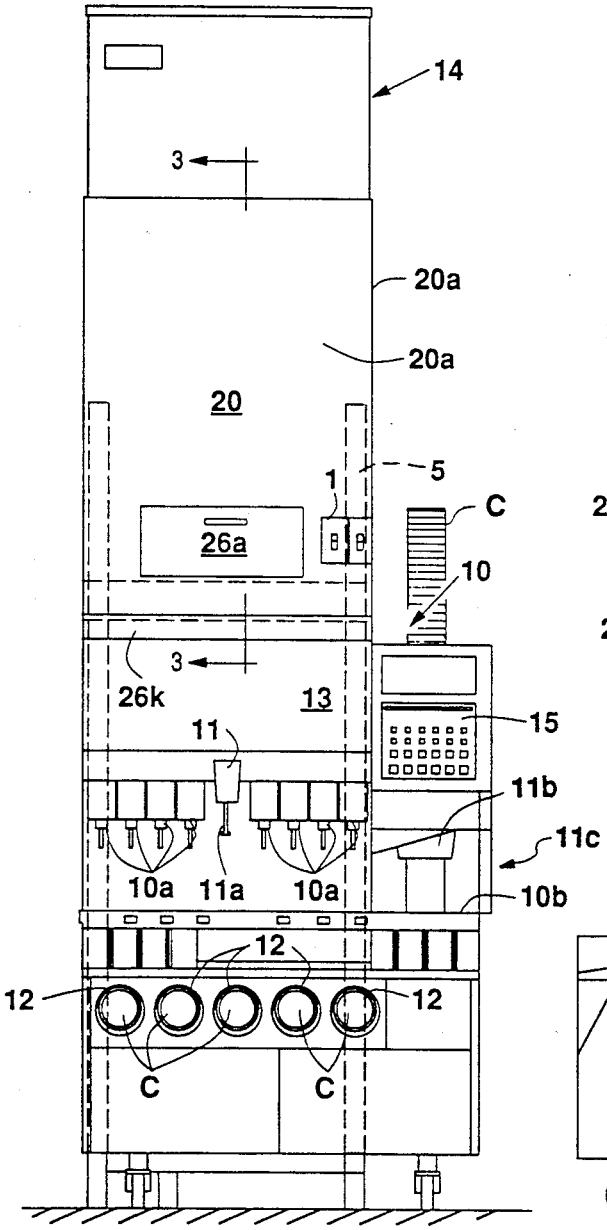
FIG. 1 is a schematic front elevational view of a conventional drink dispensing machine having a storage bin embodying this invention disposed above the drink dispensing machine.
Figure 2:
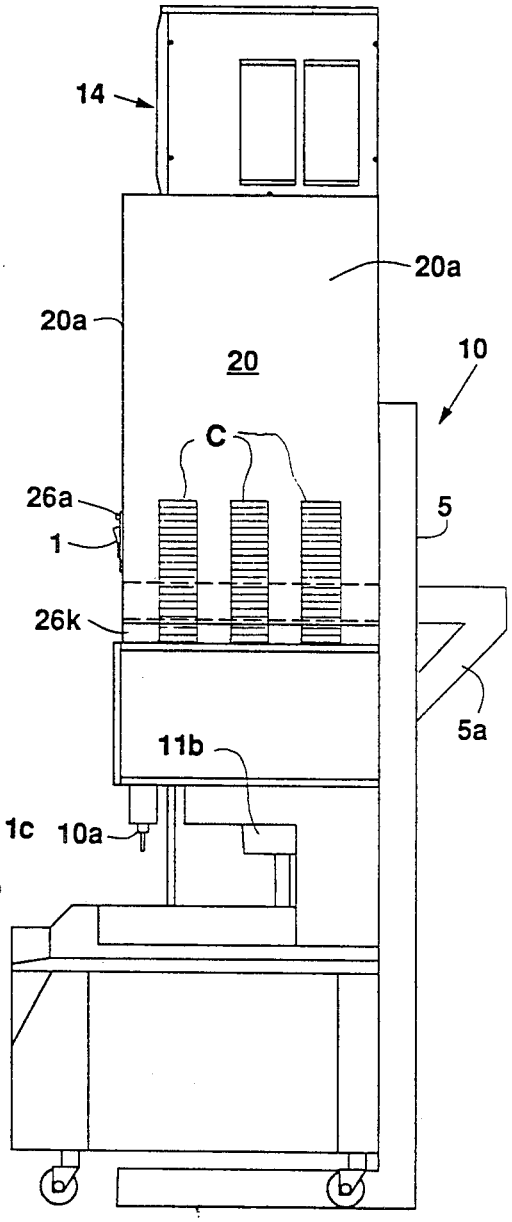
FIG. 2 is a right side elevational view of the apparatus of FIG. 1.
Figure 3:
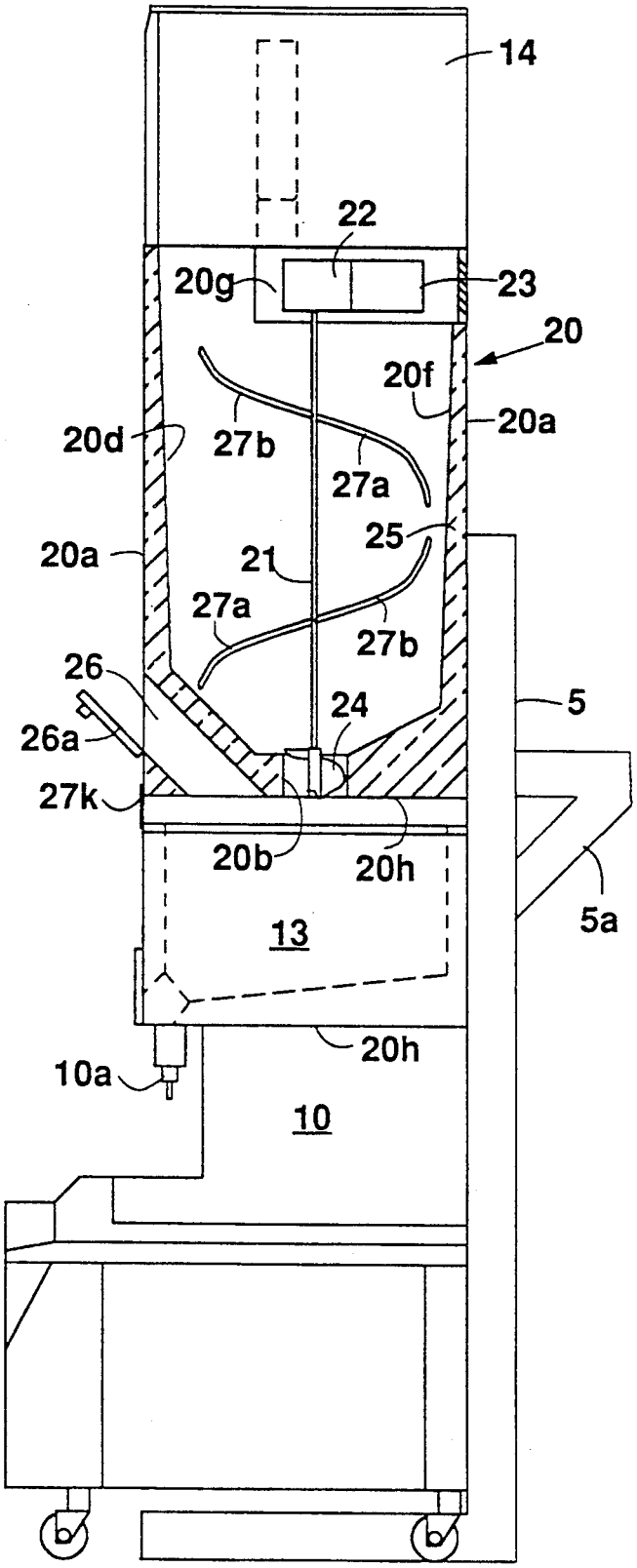
FIG. 3 is a right side elevational view of the apparatus of FIG. 1 with a portion of the apparatus shown in section taken along the plane 3—3 of FIG. 1.
Figure 4A:
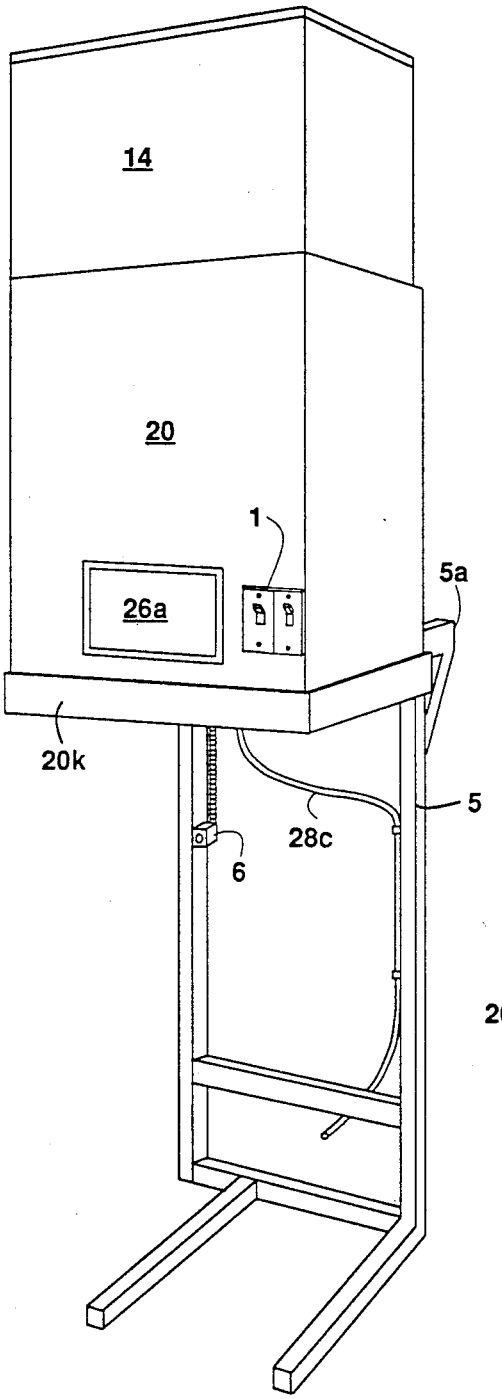
FIG. 4A is a front perspective view of the storage bin with the drink dispensing machine removed.

As best shown in FIG. 3, the conventional drink dispensing machine 10 incorporates an upwardly open ice storage and dispensing compartment 13 in its upper portion. The ice storage and dispensing compartment is normally filled with ice pieces, which are generated by a conventional ice making unit 14. In contrast to the conventional arrangement, wherein an ice making unit 14 is normally mounted directly above the ice storage and dispensing compartment 13, an ice storage bin 20 is mounted above the ice storage compartment 13 on a frame 5 independent of the drink dispensing machine 10, as shown in FIG. 4A, and has a volume at least several times greater than that of ice storage compartment 13.

The ice storage bin 20 has rectangular outer walls 20*a* and is provided with sloping interior walls 20*c*, 20*d*, 20*e* and 20*f* (FIG. 5A) in its lower portions which terminate around a cylindrical discharge opening 20*b* in the bottom wall 20*h*. Insulation 25 (FIG. 3) is provided between the outer and inner walls. A shaft 21 is vertically suspended from a gear box 22 driven by a motor 23 and the motor and gear box are respectively mounted in a ventilated compartment 20*g* in the upper portion of the storage bin 20. The shaft 21 is disposed in concentric alignment with the axis of the cylindrical discharge opening 20*b*.

Figure 5B:
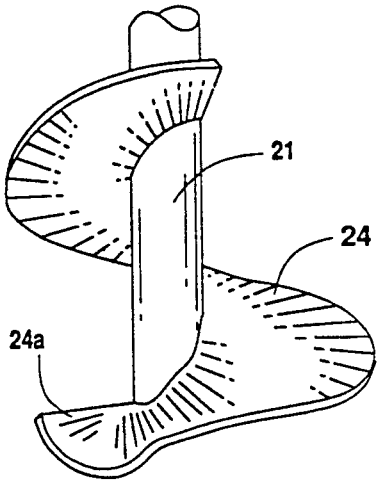
FIG. 5B is an enlarged scale perspective view of the dispensing auger utilized in the storage bin.
Figure 5C:
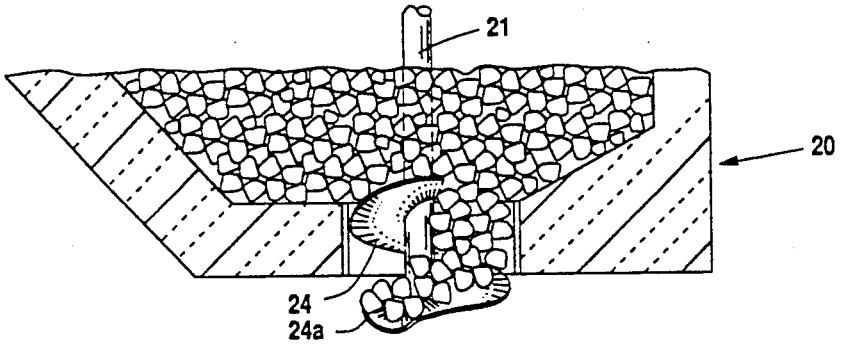
FIG. 5C is a schematic perspective view of the stoppage of ice piece flow by the auger tab.

A discharge auger is mounted on the lower end of the vertical shaft 21 and comprises a single helical vane 24 secured thereto which cooperated with the walls of the cylindrical discharge opening 20*b*. To prevent a flow of ice pieces through the discharge opening 20*b* when the shaft 21 is not rotating, the lower end of the helical vane 24 is provided with an upstanding transverse tab 24*a* generally axially aligned with the upper end of the helical vane 24, which, due to the relatively modest slope of the helical vane, prevents the ice pieces from flowing over the tab when the vane 24 is not rotating, as illustrated in FIG. 5C.

Ice pieces are supplied to storage bin 20 by the conventional ice making unit 14 (FIG. 3). In accordance with one important aspect of the invention, an opening 26 (FIG. 3) is provided in the front wall of the ice storage bin 20 to permit the manual insertion of the ice pieces directly into the ice compartment 13 of the drink dispenser in the event of any failure of the ice making unit 14 or the motor 23 driving the dispensing auger. A hinged door 26*a* normally closes the opening 26.

Figure 4B:
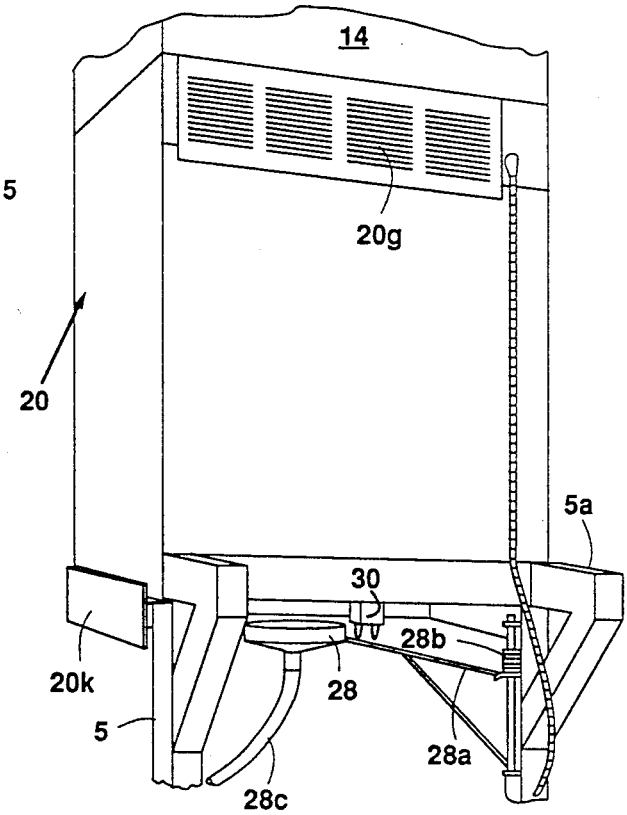
FIG. 4B is a rear perspective view of the storage bin of FIG. 4A.
Figure 5A:
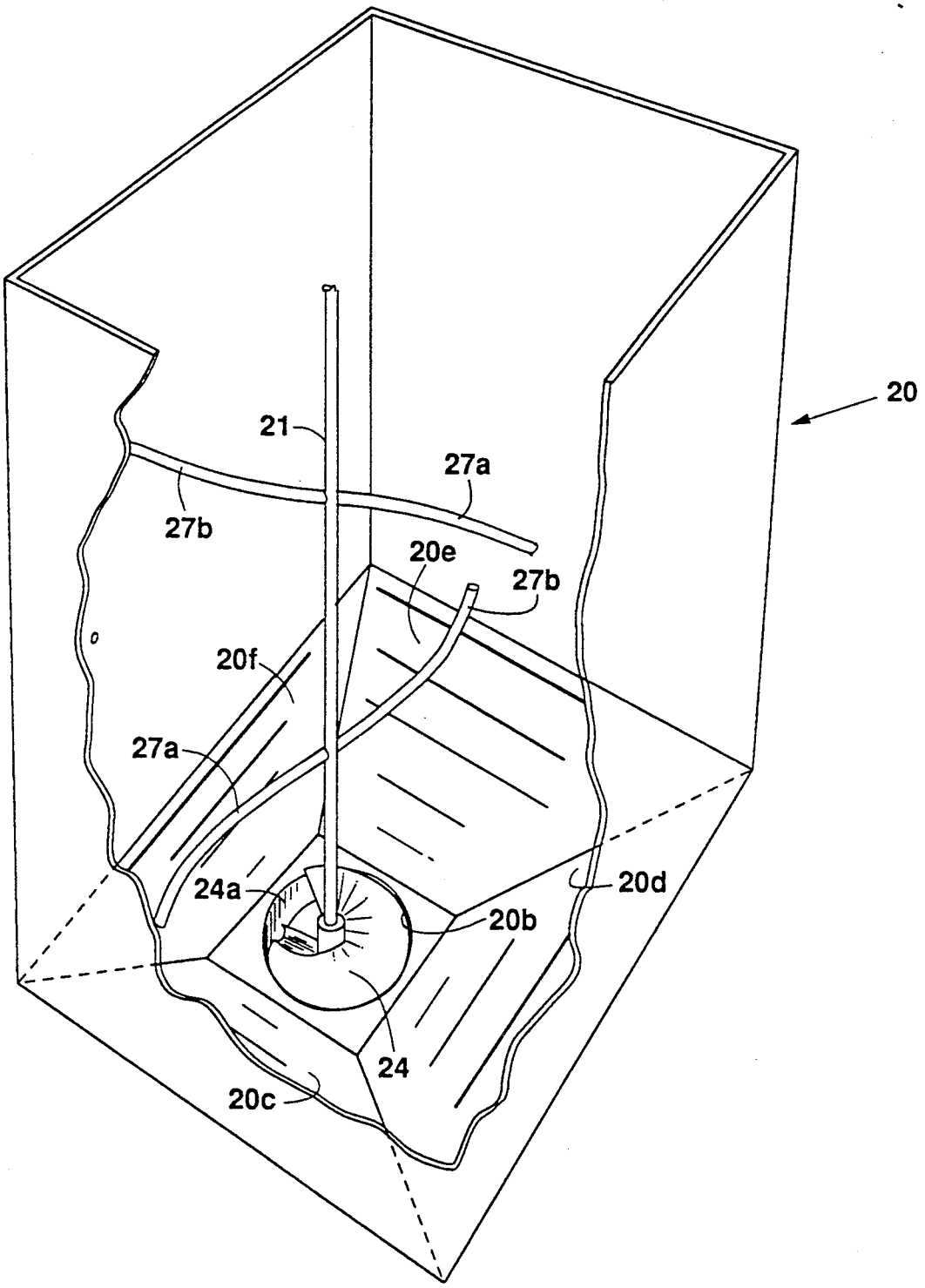
FIG. 5A is an enlarged scale perspective view looking into the top portion of the ice storage bin.
Figure 6:
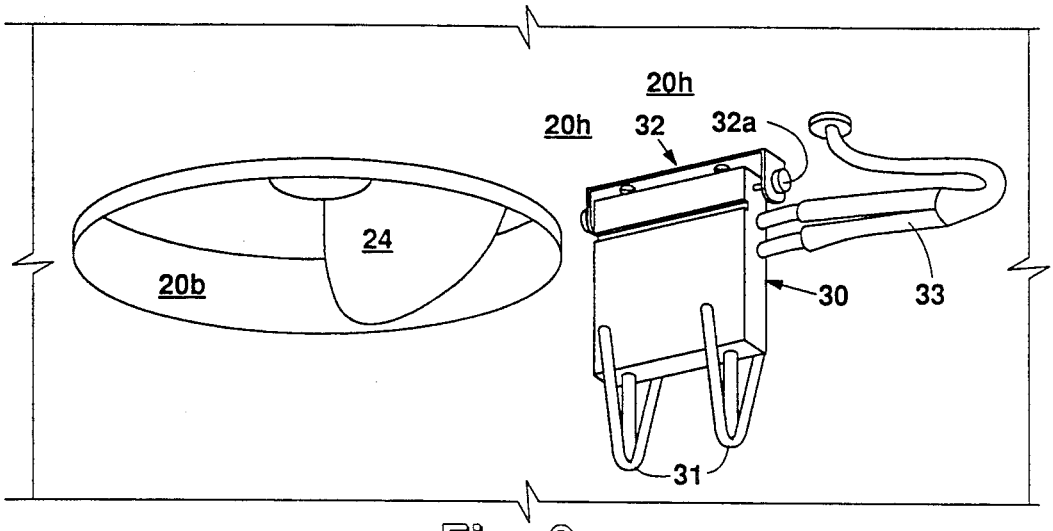
FIG. 6 is an enlarged scale perspective view showing the mounting of an ice level detector on the bottom of the storage bin.

Referring now to FIG. 4A and 4B of the drawings, there is shown details of the construction of the ice storage bin embodying this invention which are particularly useful when the ice storage bin is employed in vertical alignment with a self contained drink dispensing apparatus having an open top ice receptacle. For purposes of clarity, the self contained drink dispensing unit is not shown in FIG. 4A and 4B but it will be understood that it is mounted on rollers or slides to permit its cabinet to be rolled or pushed beneath the ice storage bin 20 and into abutment with the independent frame structure 5 upon which the ice storage bin 20 is supported. An interlock electric switch 6 is mounted on the frame 5 in a position to be actuated to a contact closing condition when the self contained drink dispensing unit is accurately positioned beneath the ice storage bin 20. The top of the cabinet of the self contained drink dispensing unit 10 normally is slightly vertically spaced below the bottom edge of the storage bin 20. The resulting gap is covered by a flexible plastic molding 20*k* which is suitably secured into position when the dispensing unit 10 and the ice storage bin 20 are properly vertically aligned.

Water resulting from the melting of ice pieces in the storage bin 20 can freely drip out of the discharge opening 20*b*. When the drink dispenser is in normal position under the bin, the water falls into the ice compartment of the drink dispenser which includes a water drain. When the drink dispensing unit 10 is not positioned below the ice storage bin 20, the water would drip on the floor. To prevent such an occurrence, a drip collecting funnel 28 is mounted on the end of a support arm 28*a* which in turn is mounted on one of the frame elements of the support frame 5 by a vertical pivot connection. A torsion spring 28*b* normally urges the drip collecting receptacle 28 into alignment with the discharge opening 20*b*. A hose 28*c* connects funnel 28 to a drain. When, however, the self contained drink dispensing unit 10 is rolled or pushed into position below the ice storage bin 20, the drip collecting receptacle 28 is pivotally moved by the top portions of the rear wall of the cabinet for the self contained unit 10 to a position behind the self contained unit 10 in a space provided by the frame projections 5*a* which space the support frame 5 forwardly of any wall against which the unit may be mounted.

The electric interlock switch 6 is wired into the control circuit for the auger motor 23 in a manner that will be subsequently described in connection with FIG. 10, to prevent such motor from being energized until the self contained drink dispensing unit 10 is disposed in accurate horizontal alignment with the storage bin 20. Thus it is assured that ice pieces discharged through the discharge opening 20*b* will enter the open top of the ice piece dispensing compartment 13 normally provided in the drink dispensing unit 10.

The controls for the motor 23 which drives the discharge auger 24 also incorporate a conventional ice piece level detecting device 30 (FIG. 6) which is positioned to detect when the ice storage and dispensing compartment 13 is full of ice pieces. Preferably, the detecting device 30 is a conductivity type detector and is pivotally mounted on a bracket 32 by pivot pins 32*a* and is connected in the control circuit for auger motor 23 by flexible leads 33. Bracket 32 is secured to the bottom wall 20*h* of the ice storage bin 20. This arrangement facilitates removal or placement of drink dispensing unit 10 relative to the ice storage bin 20, in that the conductivity probes pivot up to allow the drink dispenser to be moved into position.

The detecting device 30 is a conventional device having horizontally spaced, vertical conducting prongs 31 by which the existence of ice pieces between the prongs may be determined by the conductivity of an electrical path between the prongs 31 provided by the ice pieces. Thus, when the level of the ice pieces in ice compartment 13 reaches the bottom level of the prongs 31, a switch is opened to prevent the motor 23 from being energized through a timer switch to be described.

From the foregoing description, it will be noted that the ice storage bin 20 embodying this invention is mechanically and electrically isolated from the drink dispensing unit 10, thus permitting the drink dispensing unit 10 to be readily moved from its operative position beneath the ice pieces storage bin 20 for repair or cleaning purposes without requiring any mechanical or electrical disconnections.

The ice making unit 14 mounted on top of the ice storage bin 20 is of conventional size and configuration. It runs and produces ice until its conventional internal electro-mechanical ice level detection, typically a curtain switch, indicates that the ice has accumulated in the storage bin 20 until it has backed up into the discharge chute from the ice maker.

To prevent the ice pieces in the storage bin 20 from forming solid clusters, the auger shaft 21 is provided with a plurality of radially projecting curved stirring rods 27*a* and 27*b*. Preferably, rods 27*a* project downwardly and rods 27*b* project upwardly, and both curve in a direction opposite to the direction of rotation. This configuration functions to break up frozen clusters of ice pieces existing substantially anywhere in storage bin 20 with the minimum force. A timer switch 23*a* (FIG. 10) may be incorporated in the energization circuit for the auger motor 23 to periodically momentarily energize motor 23 for brief periods, i.e., two seconds, to break up ice particle clusters during periods of low demand for ice pieces, as will presently be described.

Figure 10:
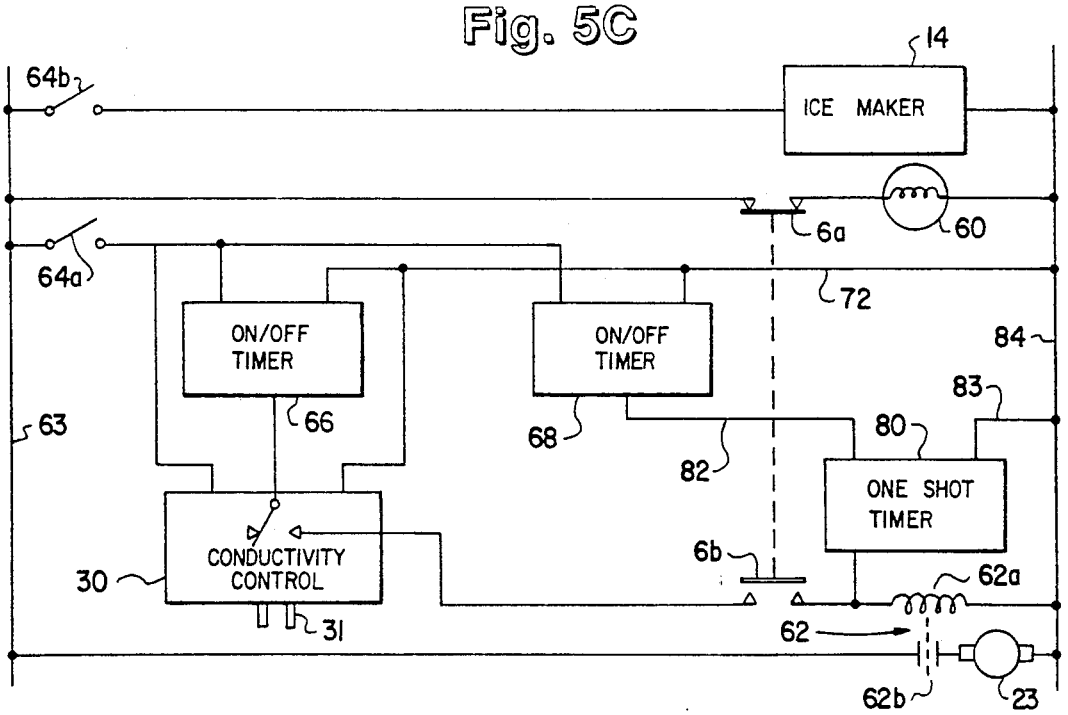
FIG. 10 is a schematic control circuit diagram for the motors driving the ice discharge auger and the ice making machine.

A control circuit for the system 10 is illustrated schematically in FIG. 10. The control system 10 includes normally closed contact 6*a* and normally open contact 6*b* of the interlock switch 6 previously described. As previously mentioned, the switch 6 is positioned to be actuated when the drink dispensing machine is in proper position under the storage bin to open contact 6*a* and close contact 6*b*. When the drink dispensing machine is not in the improper position, the contact 6*a* is normally closed and a lamp 60, preferably red, is illuminated to indicate that the system is inoperative. At the same time, switch contact 6*b* is open to disable the coil of a relay 62*c* so that the contacts of the relay 62 are opened and the agitator motor 23 is disabled, except for very brief periods to prevent the ice in the bin from freezing together as will presently be described. Power to ice maker 14 is controlled by switch 64*b*.

Power is supplied from power bus 63 through an on/off switch 64 to a first on/off timer 66, a second on/off timer 68, and the conductivity control circuit 70 having probes as heretofore described. The power circuit from the on/off timer 66, conductivity control 30 and on/off timer is returned to the other power bus 84 by lead 72. The output from the on/off timer 66 is connected by lead 76 to the switch blade 78 of the contact of the conductivity control circuit 30, which is illustrated in the open position which indicates that the ice is contacting the conductivity probes. When the switch blade 78 is closed, current is connected through the interlock switch 6b to operate the coil 62a of the relay 62. This closes the contacts 62b of the relay and operates the agitator and dispenser motor 23. The timer 66 is typically set to switch current on for two minutes an off for fifteen minutes. Thus, if the conductivity control contact 78 is closed, the agitator motor will be operated for two minutes, or until the conductivity control detects that ice in the drink dispensing machine is at the high level at which time the contact 78 opens to de-energize the coil of relay 62 and stop operation of motor 23.

The output of the on/off timer 68 is applied to the power input of a single shot timer 80 through lead 82 and the power circuit is completed through lead 83 to bus 84. When triggered on by an output from the timer 68, the output from the single shot timer 80 also energizes the relay of coil 62 through lead 86. The on/off timer 68 triggers the single shot timer 80 once each twenty minutes, for example, which produces an output to energize the coil 62 for two seconds to operate the agitator motor 23 and ensure that the ice pieces within the bin are broken up by the agitators 27a and 27b on rod 21. It will be noted from the one-shot timer bypasses contact 6f so that the ice in the bin will be broken up even if the drink dispensing machine is not in position under the bin.

Thus, the circuit of FIG. 10 operates the ice bin 20 so as to prevent dispensing of ice unless the drink dispensing machine is properly in position to close the interlock switch 6b, which position is indicated by opening the switch 6a to turn the red warning lamp 60 off. With the interlock switch 6b closed and the manual on/off switch 64 closed, the timers 66 and 68 and the conductivity control 30 are all energized. For two minutes out of each seventeen minutes, the timer 66 produces a signal on line 76 which is applied to the conductivity control 30. If the bin is not at the high or full level to contact the conductivity probes, the switch 78 will be closed and the coil of relay 62 energized to operate the agitator motor 23 and dispense ice for either two minutes, or until the ice in chamber 13 fills to a level sufficient to contact the conductivity probes, at which time the relay 62 will fall out and turn motor 23 off. If the bin 20 has an adequate supply of ice, a two minute operation of the motor 23 will normally be adequate to fill the ice chamber 13 of the drink dispensing machine. In the event there is not adequate ice for this purpose, the timer 66 will time out and terminate operation of the agitator and dispensing motor for some fifteen minutes during which time additional ice can be made and accumulated in the bin.

If both of the ice storage chambers are full, there is a likelihood that the ice within the bin 20 would freeze and stick together into a solid mass. To alleviate this, the timer 68 produces an output signal once each 20 minutes, for example, which fires the single shot timer 80 which in turn produces current through the coil of relay 62 for approximately two seconds. This period of time is adequate to turn the agitator motor 23 and break up any solidifying ice pieces without dispensing at most a few pieces of ice from the bin into the drink dispensing machine of water collection funnel if the drink machine is not in position.

Figure 7:
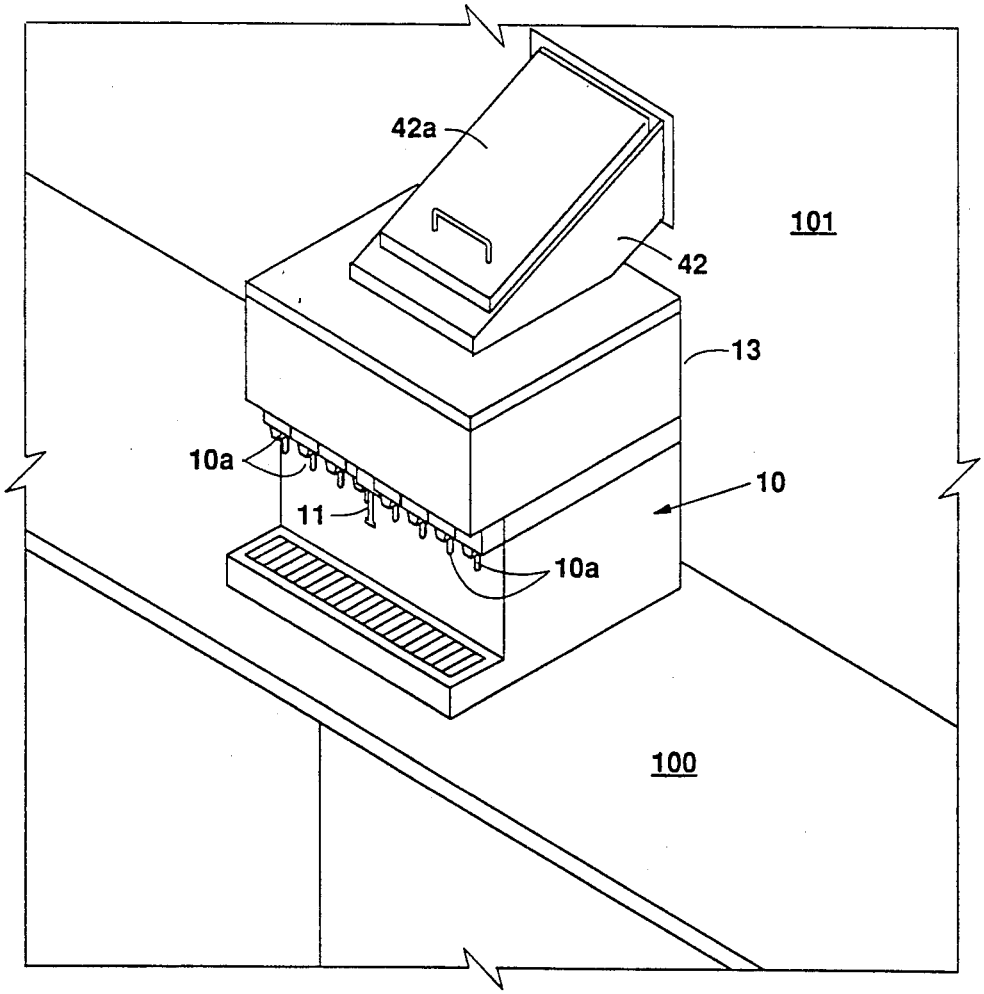
FIG. 7 is a schematic front elevational view of an apparatus in accordance with this invention wherein the ice maker and ice storage bins are disposed on the opposite side of a wall relative to the drink dispensing unit.
Figure 8:
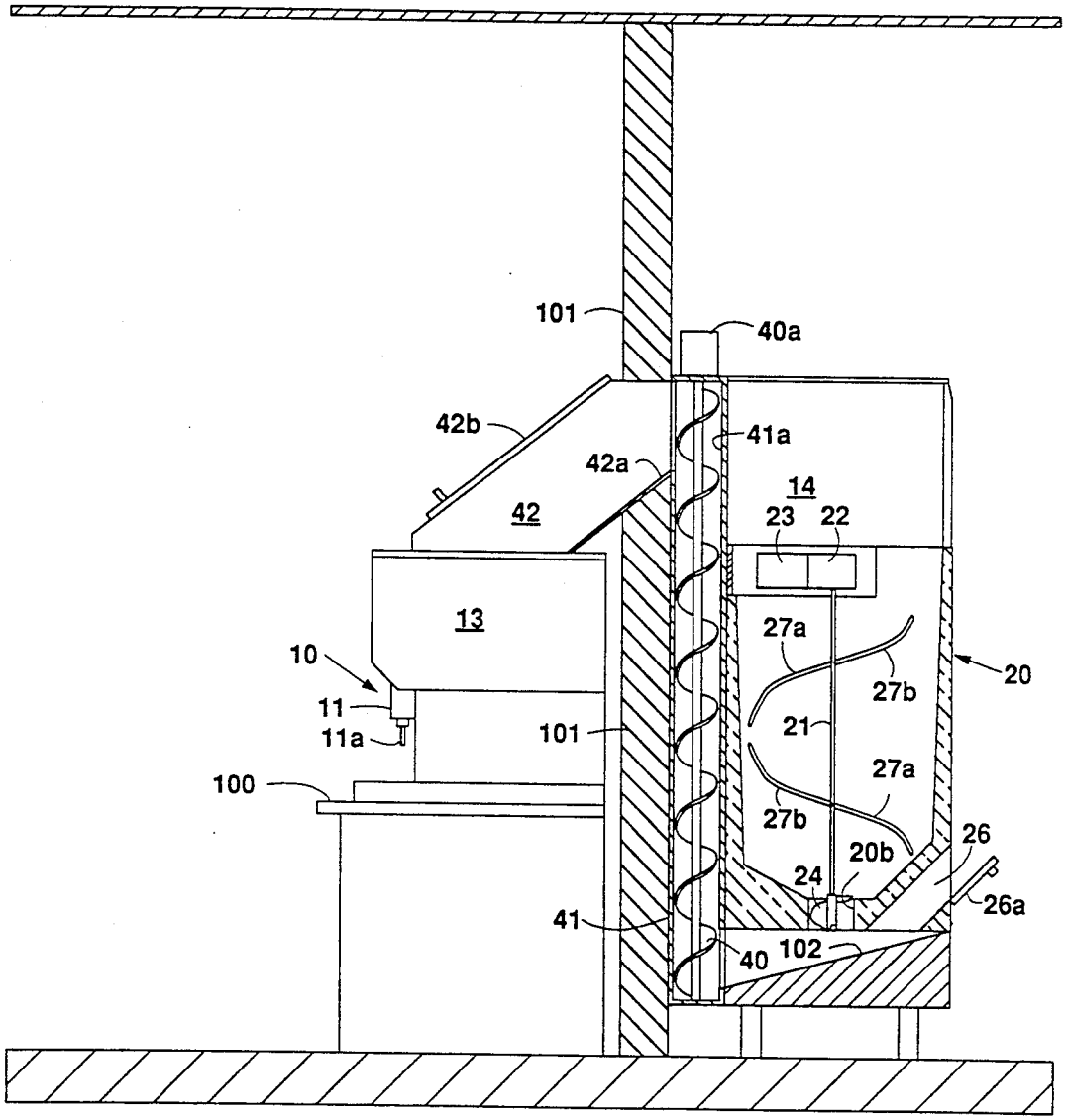
FIG. 8 is a partial vertical sectional view of the apparatus of FIG. 7.

In the event that the ice storage bin 20 and the ice maker 14 cannot be disposed above the drink dispensing apparatus 10, the embodiment of the invention shown in FIGS. 7 and 8 may be used. In the modification of FIGS. 7 and 8, the drink dispensing apparatus 10 is mounted on a counter 100 disposed on one side of a wall 101. The drink dispensing apparatus 10 is conventionally provided with an open topped ice compartment 13 as previously described. Ice is supplied to the ice storage and dispensing compartment 13 from the ice making unit 14 mounted on top of an ice storage bin 20 embodying this invention, which is disposed on the floor on the other side of vertical wall 101 as shown in FIG. 8.

The ice storage bin 20 in FIG. 8 has a similar internal configuration to that previously described for the modification of FIGS. 1-6, including a motor driven discharge auger 24 which effects the deposit of ice pieces through opening 20b onto an inclined delivery chute 102. Delivery chute 102 has a sufficient slope to effect the gravitational feed of ice particles to the bottom end of a vertical auger conveyor 40 which extends through a cylindrical chute 41 defining a vertical cylindrical bore 41a. An electric motor 40a is mounted on the top of the chute 41 to drive the augur 40. The ice pieces are thus elevated and discharged into a delivery chute 42 which projects through the wall 101 to overlie the open top ice dispensing compartment 13 of the drink dispensing unit 10. Chute 42 has a sloped bottom wall 42a to gravitationally direct the ice pieces into the dispensing compartment 13. A manual filling lid 42b is also provided on the outer face of compartment 43 to permit manual filling of dispensing compartment 13 in the event of a break down of the ice making machine 14 or the storage bin 20. While not shown, the motor 23 driving the dispensing auger 24 and the motor 40a driving the transporting auger 40 are conventionally connected in an electrical circuit that is similar to FIG. 10, except that the ice level detecting device 30 suitably mounted in the upper portion of the ice dispensing compartment 13.

Figure 9:
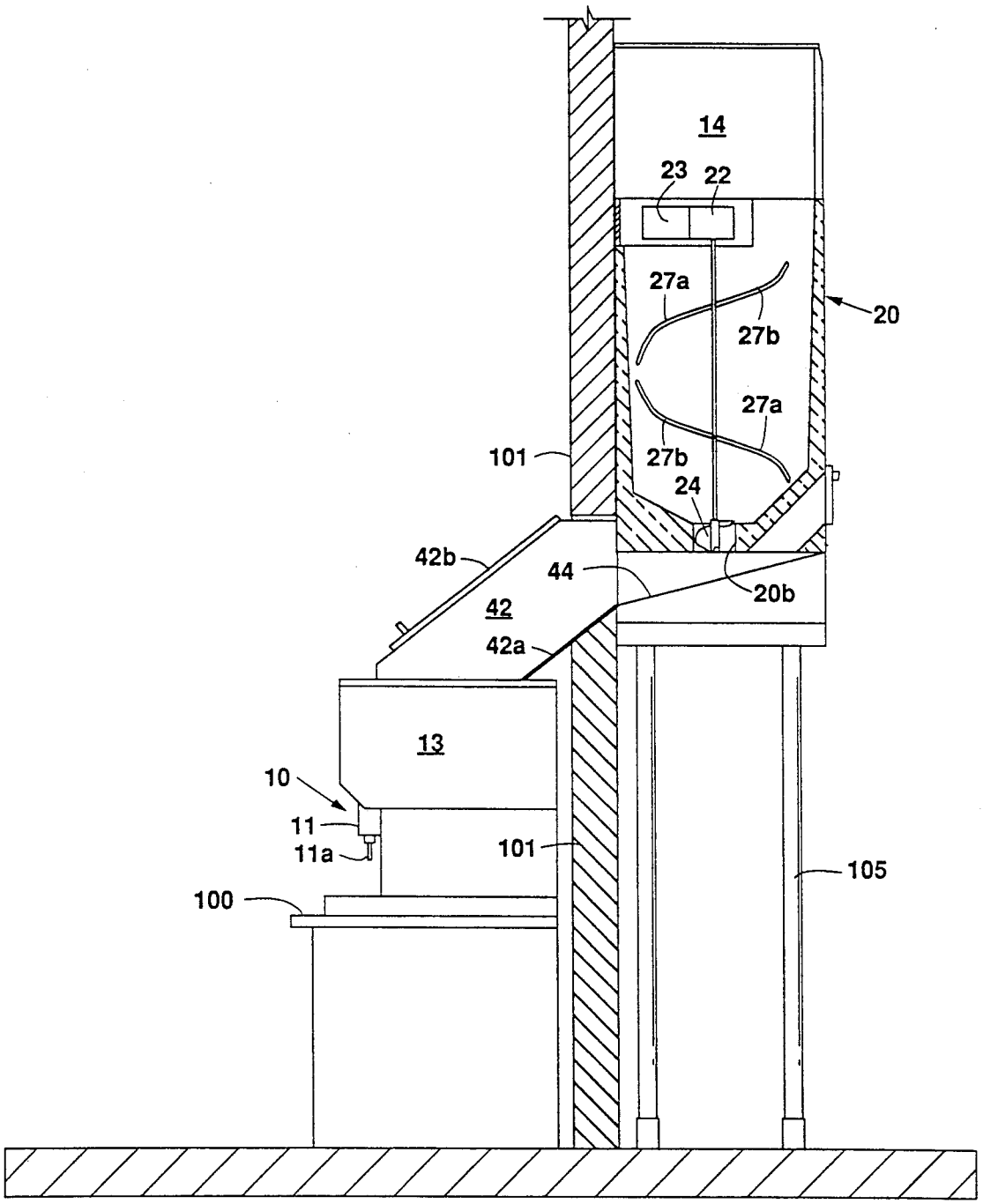
FIG. 9 is a sectional view, similar to FIG. 8, illustrating a modified arrangement of the ice storage bin according to the present invention.

An alternative embodiment of the invention is illustrated in FIG. 9 wherein the storage compartment 20 is supported in an elevated position behind the vertical wall 101 by a frame structure 105. Ice pieces discharged by the discharge auger 24 are dropped onto an inclined delivery platform 44 which communicates with the delivery chute 42 previously described in FIG. 8 as extending through the wall 101 and communicating with the ice piece dispensing compartment 13 of the drink dispensing machine 10. The controls for this modification are substantially similar to that shown in FIG. 10 with the exception again that the ice piece level detecting switch 30 is suitably mounted within the upper portion of the ice dispensing compartment 13.

Those skilled in the art will appreciate that the aforedescribed invention provides a drink dispensing apparatus which will assure an adequate supply of ice pieces during peak operations of the dispensing apparatus. The combined volume of the ice storage compartment 13 and the ice storage bin 20 is selected so as to equal or exceed the maximum anticipated demand for ice pieces during peak periods of use of the dispensing apparatus 10. Thus the need for manually refilling the ice storage compartment 13 during such peak periods is essentially eliminated.

What is claimed and desired to be secured by Letters Patent is:

1. Apparatus for dispensing ice pieces comprising:

a dispensing storage bin for ice pieces having means for discharging a desired quantity of ice pieces into a drinking container;

an ice piece storage bin separate from said dispensing storage bin having an output of ice pieces that is greater than the anticipated maximum rate of discharge of ice pieces from said dispensing storage bin during peak demand periods;

means for discharging ice pieces from said ice piece storage bin to said dispensing storage bin;

switch means in said dispensing storage bin responsive to preselected minimum and maximum levels of ice pieces in said dispensing storage bin for selectively operating said means for discharging ice pieces from said storage bin to said dispensing storage bin;

an ice piece generator having an output capacity of ice pieces substantially less than the anticipated maximum rate of discharge of ice pieces from said dispensing storage bin during peak demand periods; and means for discharging ice pieces from said ice piece generator into said ice piece storage bin.

2. The apparatus of claim 1 wherein said means for discharging ice pieces from said ice piece storage bin to said dispensing storage bin comprises a motor driven means;

a cylindrical discharge opening in the bottom of said storage bin;

a motor driven shaft concentrically traversing said discharge opening;

a helical blade secured to said motor driven shaft and cooperating with the wall of said discharge opening to feed ice pieces through said discharge opening; and radial tab means on the lower end of said helical blade preventing passage of ice pieces through said discharge opening when said shaft is not rotating.

3. The apparatus of claim 2 wherein said radial tab is upstanding and transversely disposed relative to said helical blade.

4. The apparatus of claim 2 further comprising agitators secured to said shaft for breaking frozen clusters of the ice pieces in said storage bin when said shaft is not rotating.

5. The apparatus of claim 1, 2, 3 or 4 wherein said ice piece storage bin is disposed above said ice piece dispensing storage bin.

6. The apparatus of claim 2, 3 or 4 further comprising timer switch means operatively connected with said motor driven means to limit the operating time period of said motor driven means.

7. Apparatus for dispensing ice pieces comprising:

a dispensing compartment for ice pieces having means for discharging a desired quantity of ice into a drinking container;

an ice piece storage bin;

said ice piece storage bin being located horizontally adjacent said ice piece dispensing compartment;

motor operated conveyor means for transferring ice pieces discharged from said ice piece storage bin to said dispensing compartment;

motor driven auger means for discharging ice pieces from said ice particle storage bin to said conveyor means;

electrical switch means in said dispensing compartment responsive to preselected minimum and maximum levels of ice pieces in said ice particle dispensing compartment to respectively energize or de-energize said motor operated conveyor means and said motor driven means for discharging ice pieces from said storage bin;

an electrically operated ice piece generator having an output capacity of ice pieces substantially less than the anticipated maximum rate of discharge of ice pieces from said dispensing compartment during peak demand periods;

means for discharging ice pieces from said ice piece generator into said ice piece storage bin; and means for de-energizing said electrically operated ice piece generator when said ice piece generator is substantially filled with ice pieces.

8. The apparatus of claim 7 wherein said motor driven auger mans comprises: a cylindrical discharge opening in the bottom of said storage bin;

a motor driven shaft concentrically traversing said discharge opening;

a helical blade secured to said motor driven shaft and cooperating with the wall of said discharge opening to feed ice pieces through said discharge opening; and radial tab means on the lower end of said helical blade preventing passage of ice pieces through said discharge opening when said shaft is not rotating.

9. The apparatus of claim 8 wherein said radial tab is upstanding and transversely disposed relative to said helical blade.

10. The apparatus of claim 8 further comprising agitators secured to said shaft for breaking frozen clusters of the ice pieces in said storage bin when said shaft is not rotating.

11. The apparatus of claim 7, 8, 9 or 10 wherein said ice piece generator is disposed above said ice piece storage bin.

12. The apparatus of claims 7, 8, 9 or 10 further comprising timer switch means operatively connected with said motor driven means to limit the operating time period of said motor driven means.

13. Apparatus for storing and dispensing ice pieces comprising:

a compartment having a bottom wall and a plurality of side walls;

a cylindrical vertical discharge passage in said bottom wall;

said side walls having inwardly tapered bottom portions surrounding said discharge opening;

a motor driven vertical shaft traversing said compartment and said discharge opening, said motor driven shaft being coaxially aligned with said discharge opening;

an auger secured to said motor driven shaft within said discharge opening;

said auger comprising a single helical vane of substantially 360− peripheral extent; and an upstanding tab formed on the bottom end of said helical vane, whereby rotation of said motor driven shaft forcibly moves ice pieces through said discharge opening and stopping said rotation prevents gravitational flow of ice pieces through said discharge opening.

14. The apparatus of claim 13 further comprising agitation means secured to said motor driven shaft for breaking frozen clusters of ice pieces as said motor driven shaft rotates.

15. The apparatus of claim 14 wherein said agitation means comprises at least two rods, one of said rods extending radially upwardly and outwardly and the other rod extending radially downwardly and outwardly, whereby said rods pass through substantially all the volume of said compartment.

16. The apparatus of claim 14 further comprising control means for said motor including a timer for intermittently energizing said motor to break up any clusters of ice pieces.

17. Apparatus for dispensing ice pieces and beverages comprising:

an ice piece storage bin;

means for delivering ice pieces into the top of said storage bin;

frame structure supporting said storage bin in an elevated position relative to a horizontal surface;

a self contained beverage dispensing unit movable on said horizontal surface to a predetermined position underlying said storage bin;

said beverage dispensing unit having an open top ice piece compartment and means for dispensing ice pieces from said ice piece compartment;

said ice piece storage bin having a bottom wall and a discharge opening in said bottom wall aligned with said open top of said ice piece compartment when said beverage dispensing unit is in said predetermined position;

motor operated means for feeding ice pieces through said discharge opening and into said open top of said ice piece compartment;

electrical switch means responsive to the level of ice pieces in said ice piece compartment for energizing and de-energizing said motor operated means; and interlock switch means on said frame structure for preventing energization of said motor operated means until said beverage dispensing unit is accurately located in said predetermined position beneath said ice storage bin.

18. Apparatus for dispensing ice pieces and beverages comprising:

an ice piece storage bin;

means for delivering ice pieces into the top of said storage bin;

a frame structure supporting said storage bin in an elevated position relative to a horizontal surface;

a self contained beverage dispensing unit movable on said horizontal surface to a predetermined position underlying said storage bin;

said beverage dispensing unit having an open top ice piece compartment and manually operated means for dispensing ice pieces from said ice piece compartment;

said ice piece storage bin having a bottom wall and discharge opening in said bottom wall aligned with said open top of said ice piece compartment when said beverage dispensing unit is in said predetermined position;

motor operated means for feeding ice pieces through said discharge opening and into said open top of said ice piece compartment;

electrical switch means responsive to the level of ice pieces in said ice piece compartment for energizing and de-energizing said motor operated means;

a drip receptacle;

a support arm for said drip receptacle pivotally mounted on said frame structure to move said drip receptacle into vertical alignment with said discharge opening to catch water produced by melting ice pieces in said storage bin when said beverage dispensing unit is moved out from under said ice storage bin.

19. The apparatus of claim 18 further comprising resilient means urging said support arm to said position where said drip receptacle is vertically aligned with said discharge opening.

20. The apparatus of claim 19 further comprising a flexible drain hose connected to said drip receptacle.

21. The apparatus of claim 18 further comprising interlock switch means on said articulated frame structure for preventing energization of said motor operated means until said beverage dispensing unit is accurately located in said predetermined position beneath said ice storage bin.

22. The apparatus of claim 17 wherein said electrical switch means comprises a conductivity sensitive switch element horizontally pivotally secured to said bottom wall of said ice particle storage bin in depending relation, thereby permitting movement of said beverage dispensing unit to and from said predetermined position without disconnection of said electrical switch means.

23. Apparatus for dispensing ice pieces and beverages comprising:

an ice piece storage bin;

means for delivering ice pieces into the top of said storage bin;

a frame structure supporting said storage bin in an elevated position relative to a horizontal surface;

a self contained beverage dispensing unit movable on said horizontal surface to a predetermined position underlying said storage bin;

said beverage dispensing unit having an open top ice piece compartment and means for dispensing ice pieces from said ice piece compartment;

said piece storage bin having a bottom wall and discharge opening in said bottom wall aligned with said open top of said ice piece compartment when said beverage dispensing unit is in said predetermined position;

motor operated means for feeding ice pieces through said discharge opening and into said open top of said ice piece compartment;

electrical switch means responsive to the level of ice pieces in said ice piece compartment for energizing and de-energizing said motor operated means;

said motor operated means including a rotating vertical shaft; and agitator means carried by said shaft for breaking up frozen clusters of ice pieces in said ice piece storage bin.

* * * * *